United States Patent [19]

Nishise et al.

[11] Patent Number: 4,803,513

[45] Date of Patent: Feb. 7, 1989

[54] TONER SUPPLYING DEVICE

[75] Inventors: Hideya Nishise, Toyohashi; Susumu Sakakibara, Toyokawa; Masaru Imaizumi, Shinshiro, all of Japan

[73] Assignee: Minolta Camera Kabushiki Kaisha, Osaka, Japan

[21] Appl. No.: 7,897

[22] Filed: Jan. 28, 1987

[30] Foreign Application Priority Data

Jan. 28, 1986 [JP] Japan ..... 61-011317[U]

[51] Int. Cl.[4] ..... G03G 15/08

[52] U.S. Cl. ..... 355/3 DD; 355/3 R

[58] Field of Search ..... 355/3 R, 3 DD, 14 D; 222/DIG. 1; 366/156, 297, 300

[56] References Cited

U.S. PATENT DOCUMENTS

| | | | |
|---|---|---|---|
| 3,448,724 | 6/1969 | Chawda et al. | 355/3 DD X |
| 3,664,299 | 5/1972 | Shaler et al. | 118/652 |
| 3,912,388 | 10/1975 | Takahashi et al. | 355/3 DD |
| 3,951,309 | 4/1976 | Kadowaki | 222/DIG. 1 X |
| 4,173,405 | 11/1979 | Swapceinski et al. | 355/3 DD |
| 4,607,933 | 8/1986 | Haneda et al. | 355/3 DD |
| 4,632,534 | 12/1986 | Shimono | 355/14 D X |
| 4,659,211 | 4/1987 | Oka | 355/14 D |

FOREIGN PATENT DOCUMENTS

| | | | |
|---|---|---|---|
| 48-59847 | 8/1973 | Japan . | |
| 57-63358 | 4/1982 | Japan . | |
| 58-127962 | 7/1983 | Japan | 355/3 DD |
| 59-140472 | 8/1984 | Japan | 355/14 D |
| 60-98467 | 6/1985 | Japan | 355/3 DD |
| 60-229045 | 11/1985 | Japan | 355/3 DD |

*Primary Examiner*—A. C. Prescott
*Assistant Examiner*—Jane Lau
*Attorney, Agent, or Firm*—Wenderoth, Lind & Ponack

[57] ABSTRACT

A toner supplying device of the present invention has a toner storage tank having a toner supply opening in its bottom for accommodating a toner therein; a first toner transport member disposed within the storage tank and drivingly rotatable for transporting the toner; a second toner transport member disposed within the storage tank in parallel with the first toner transport member and drivingly rotatable for transporting the toner in a direction opposite to the direction of transport by the first toner transport member; and a cover covering the first toner transport member and the toner supply opening, yet only partially covering the first toner transport member. With this device, an excess of toner is prevented from flowing out from the storage tank through the opening since the cover is provided at an intermediate portion of the path of transport of the toner for covering the first toner transport member and the toner supply opening.

7 Claims, 4 Drawing Sheets

BEST AVAILABLE COP

TONER SUPPLYING DEVICE

BACKGROUND OF THE INVENTION

The present invention relates to a toner supplying device for supplying toner to an electrostatic latent image developing unit for use in electrophotographic copying apparatus and the like.

Conventionally, such toner supplying devices are known as disclosed in Unexamined Japanese patent application No. 48-59847. The known device comprises a screw roller which is provided in a toner storage tank for transporting toner in the tank in a predetermined direction. The toner transported by the screw roller is supplied to a developing unit through an opening formed in the side wall of the storage tank near its bottom.

Such toner supplying devices adjust the amount of toner to be supplied to the developing unit according to the amount of rotation of the screw roller, so that these devices are widely used. However, the transport of toner in the predetermined direction by the screw roller, which is provided singly, displaces the toner toward the transport direction within the storage tank, with the result that the toner is inaccurately supplied.

In view of this, the present inventor discloses in Unexamined Japanese Utility Model application No. 57-63358 a device which comprises a first screw roller for transporting toner to an opening formed in the side wall of the toner storage tank close to the bottom thereof and a second screw roller for transporting the toner in a direction opposite to the direction of transport by the first screw roller. This device precludes the displacement of toner because the toner is circulated at the bottom of the storage tank.

However, in the toner supplying devices of both types described above, the opening provided in the storage tank for supplying toner is positioned at the lowermost part of the side wall of the tank. The toner is transported through this opening to a projecting member in the form of a pipe and then to the developing unit through an outlet of the projecting member.

While the projecting member is adapted to prevent the overflow of toner from the outlet in an amount greater than is transported by the screw rollers, the position of the projecting member is inevitably limited by the structure of the device, consequently limiting the position of the outlet and presenting difficulties in designing. More specifically, it becomes impossible to provide a toner storage tank of sufficient capacity owing to the position and configuration of the projecting member if the position of the developing unit or the space for the toner supplying device is limited.

SUMMARY OF THE INVENTION

The main object of the present invention is to provide a device for supplying toner with a simple construction free of the foregoing drawbacks.

Another object of the invention is to provide a device having no projecting member and nevertheless capable of supplying toner.

Another object of the invention is to provide a device for supplying toner to a developing unit without the outflow of an excess of the toner.

These and other objects of the invention can be fulfilled by providing a toner supplying device which comprises a toner storage tank having a toner supply opening in its bottom for accommodating a toner therein, a first toner transport member disposed within the storage tank and drivingly rotatable for transporting the toner, a second toner transport member disposed within the storage tank in parallel with the first toner transport member and drivingly rotatable for transporting the toner in a direction opposite to the direction of transport by the first toner transport member, and a cover covering the first toner transport member and the toner supply opening but not covering the first toner transport member at least partially.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DESCRIPTION OF THE PREFERRED EMBODIMENT

An embodiment of the present invention will be described with reference to the drawings.

Figure 1:
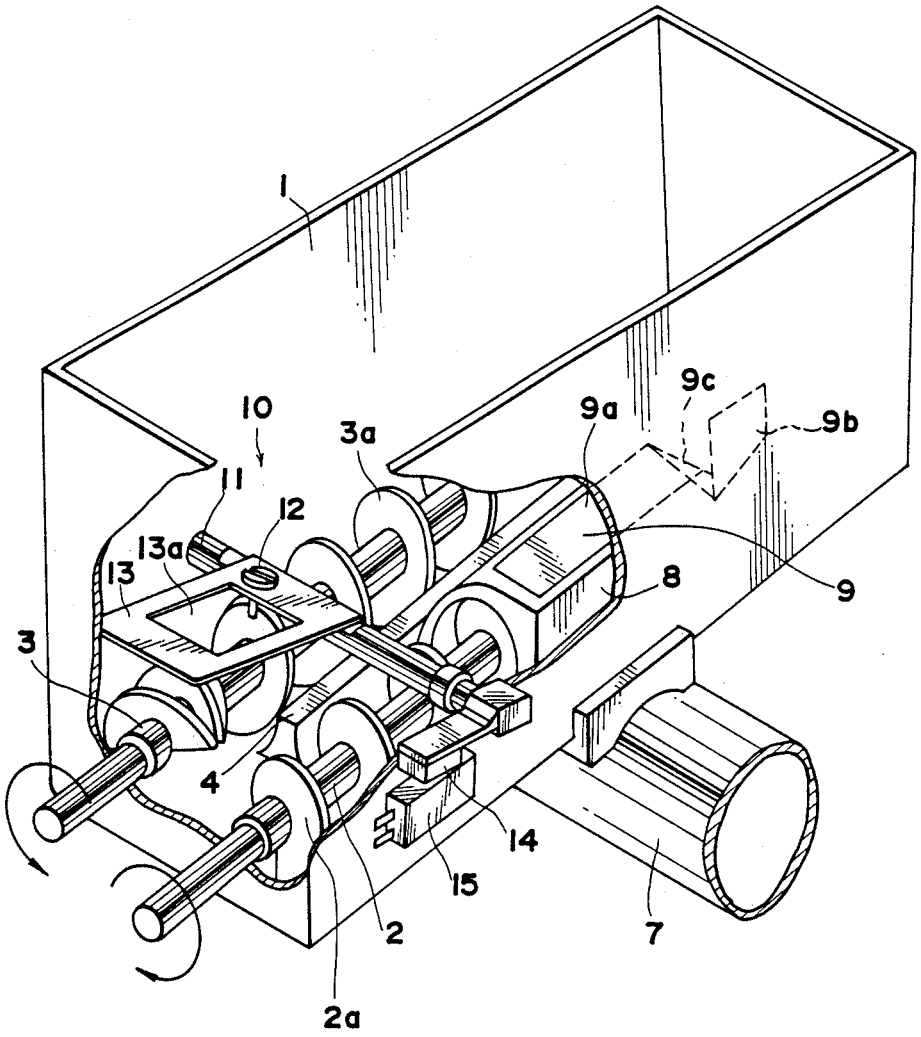
FIG. 1 is a perspective view showing a toner supplying device embodying the invention.
Figure 2:
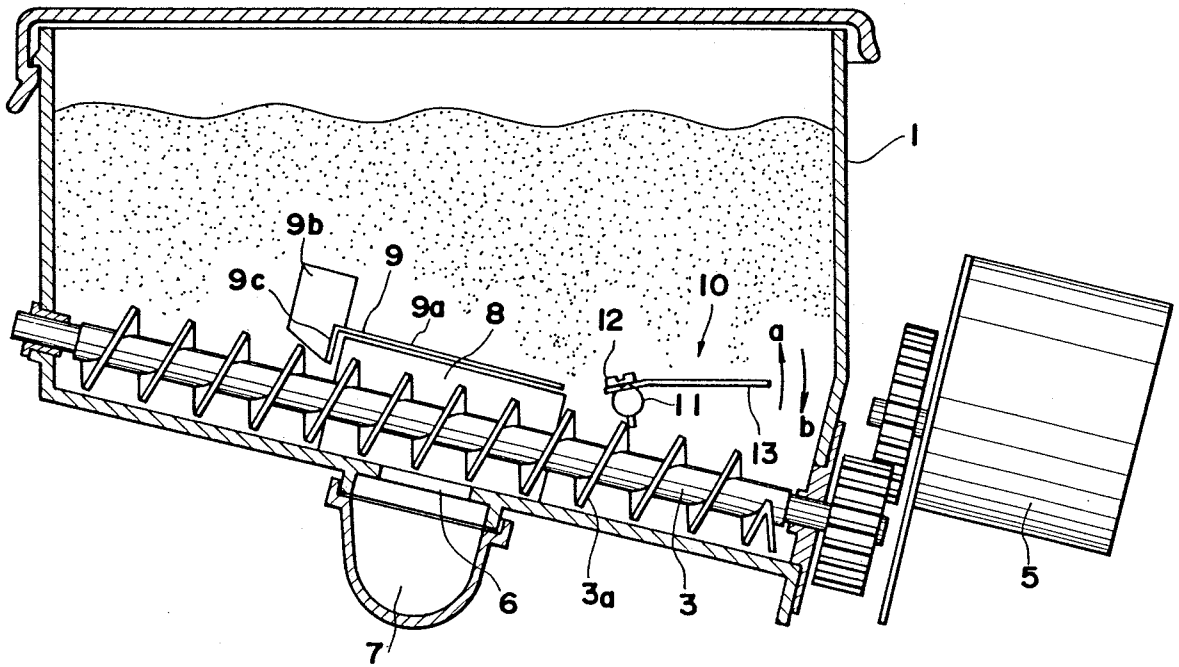
FIG. 2 is a front view in section showing the toner supplying device of the invention.

FIGS. 1 and 2 are a perspective view and a front view in section, respectively, of a toner supplying device embodying the invention.

With reference to these drawings, the bottom of a toner storage tank 1 for accommodating a toner therein has a predetermined inclination with respect to a horizontal plane. First and second screw rollers 2 and 3 for transporting the toner extend longitudinally of the storage tank 1 and are arranged side by side within the tank 1 close to its bottom, with a partition 4 interposed between the rollers. These screw rollers 2 and 3 are coupled to a drive motor 5 and are each thereby rotatable in the direction of arrow shown.

Figure 3:
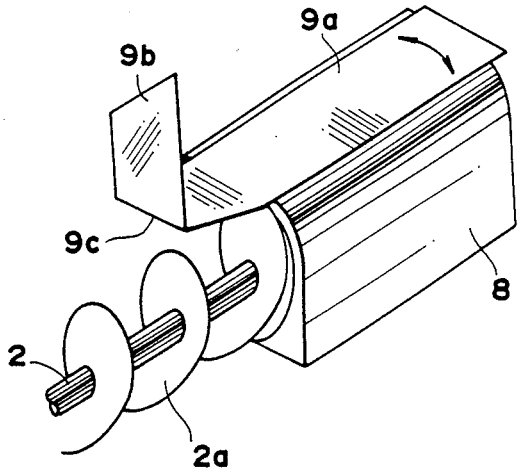
FIG. 3 is a perspective view showing a cover and a vibration plate included in the embodiment.

The first screw roller 2, when drivingly rotated, transports the toner from the lower portion of the storage tank 1 toward the upper portion thereof (i.e. from the right end of the tank 1 shown in FIG. 2 toward the other end) along the inclined bottom. At an intermediate portion of the path of transport of the toner by the first screw roller 2, the bottom is formed with a supply opening 6, through which the toner is supplied to a developing unit via a toner pipe 7. A cover 8 forming a tunnel and covering the first screw roller 2 is provided over the supply opening 6 for preventing an excess of toner from flowing from the interior upper portion of the tank 1 outward through the supply opening 6. Disposed immediately above the top of the cover 8 is a vibration plate 9 by which the toner conveyed by th first screw roller 2 is prevented from undergoin bridging phenomenon due to accumulation o cover 8. As seen in FIG. 3, the vibration plate prises a vibrating portion 9a opposed to the

BEST AVAILABLE COP fixed portion 9b fixed to a side wall of the storage tank 1, and a projection 9c projecting into the space between opposed adjacent portions of a blade 2a of the screw roller 2 and adapted to come into and out of contact with the blade 2a for vibrating the vibrating portion 9a in the directions of arrows shown with the rotation of the fist screw roller 2.

On the other hand, the second screw roller 3, when drivingly rotated, transports the toner in a direction opposite to the direction of transport by the first screw roller 2, i.e. from the upper portion of the storage tank 1 toward the lower portion thereof (from the left end of the tank 1 in FIG. 2 toward the right end). The first screw roller 2 and the second screw roller 3 are of the same construction, but rotate in different directions with respect to each other. In the vicinity of the bottom lower portion of the tank 1, the second screw roller 3 is provided with a toner empty (i.e. absence of toner) detector 10.

The toner empty detector 10 has a rotatable rod 11 extending at right angles with the second screw roller 3. A detector plate 13 is attached to the rod 11 by a screw 12 at a position immediately above the second screw roller 3. The screw 12 is a stepped screw threaded only toward its head. The forward end of the screw 12 extends through the rod 11 into the space between opposed adjacent portions of a blade 3a of the second screw roller 3 and is adapted to come into and out of contact with the blade 3a to pivotally move the detector plate 13 with the rotation of the second screw roller 3. The detector plate 13 is centrally formed with an opening 13a so that the toner will not apply an excessive load thereto when the plate 13 is pivotally moved. The rod 11 is provided at the portion thereof projecting from the storage tank 1 with a magnet lever 14. A reed switch 15 is disposed below the lever 14.

Figure 4:
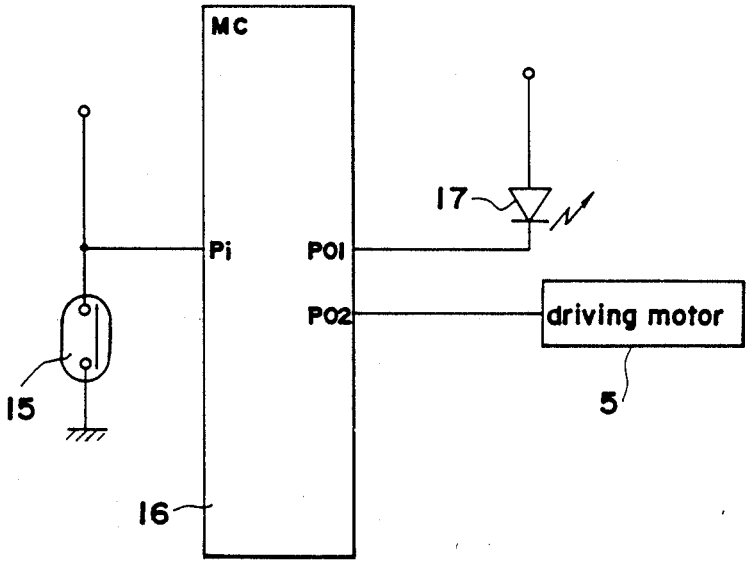
FIG. 4 is a diagram showing a signal circuit for detecting toner empty (absence of toner)

As shown in FIG. 4, the reed switch 15 is connected to an input port Pi of a microcomputer 16. The microcomputer 16 detects toner empty (absence of toner) in accordance with the input from the reed switch 15. The microcomputer 16 has an output port Po1 connected to a toner empty display 17 for indicating the absence of toner detected, and another output port Po2 connected to the drive motor 5 for driving the first and second screw rollers 2, 3. The drive motor 5 is controlled by the microcomputer 16.

The toner supplying device thus constructed operates in the following manner.

At the bottom of the storage tank 1, the toner within the tank 1 is transported by the first screw roller 2 from the lower portion of the inclined bottom surface toward the upper portion thereof. The portion of toner filling the furrow of the screw roller 2 is supplied from the supply opening 6 under the cover 8 to the toner pipe 7 and then to the developing unit. On the other hand, the portion of toner on the upper portion of the inclined bottom surface is conveyed toward the lower portion thereof by the second screw roller 3. Even when the amount of toner has decreased, the remaining toner is collected at the lower portion of the inclined surface by the second screw roller 3 and by the gravity acting on the toner itself, so that the ratio of toner filling the furrow of the first screw roller 2, namely, the amount of supply, remains constant until the tank 1 becomes almost empty. Further since the toner is circulated at the bottom of the storage tank 1, the toner can be supplied in an amount in proportion to the number of revolutions of the first screw roller 2 irrespective of the position of the supply opening 6.

According to the present embodiment, the cover 8 is provided at an intermediate portion of the path of transport of the toner by the first screw roller 2 for covering the roller 2 and the toner supply opening 6. This obviates the likelihood that an excess of toner will flow out from the storage tank 1 through the opening 6. Since the position of the toner supply opening 6 can be determined freely, the toner supplying device can be so shaped as required for the components of the main structure of the copying machine or the like.

According to the present invention, it is required that the first screw roller 2 be left uncovered with the cover 8 at least partially. If the first screw roller 2 is completely covered with the cover 8, the toner will not be fed to the roller 2 efficiently, that is, the quantity of toner filling the furrow of the first screw roller 2 will decrease. The first screw roller 2 must therefore be left uncovered by the cover 8 at least partially as stated above.

Next, a description will be given of the operation of the toner empty detector 10.

With the rotation of the second screw roller 3, the detector plate 13 is raised in the direction of arrow a shown in FIG. 2 by the contact of the forward end of the screw 12 with the blade 3a of the roller 3. As the roller 3 further rotates, the screw end comes out of contact with the blade 3a, permitting the detector plate 13 to lower under gravity in the direction of arrow b. This movement of the detector plate 13 pivotally moves the magnet lever 14 through the rod 11. However, while a sufficient amount of toner remains in the tank 1, the detector plate 13 is prevented by the toner from moving in the direction of arrow b, so that the lever 14 will not turn on the reed switch 15 therebelow, whereas when the amount of toner has decreased, the downward movement of the lever 14 turns on the reed switch 15. When thus turned on, the switch 15 feeds a signal to the microcomputer 16, in which a decision is made as to whether the toner storage tank 1 is empty.

Figure 5:
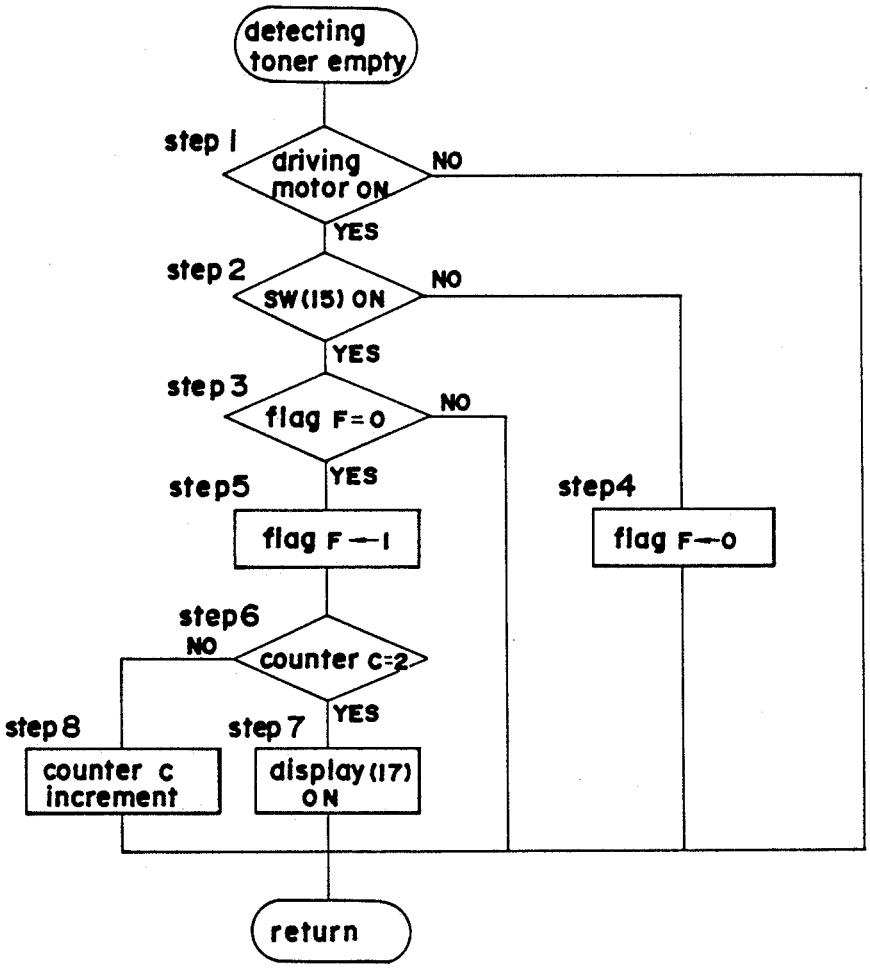
FIG. 5 is a flow chart showing the toner empty detection process to be executed by a microcomputer.

The process to be executed within the microcomputer 16 for the determination of toner empty will be described below with reference to the flow chart of FIG. 5.

As already stated, the toner empty detector 10 checks the presence of toner with a given period with the rotation of the second screw roller 3. Accordingly, it is impossible to effect toner empty detection while the second screw roller 3 to be driven by the motor 5 is held out of rotation. With reference to the flow chart, the sequence proceeds from step 1 to step 2 for the detection of toner empty if the drive motor 5 is in operation. If otherwise, the sequence immediately returns.

Step 2 checks whether the reed switch 15 is on or off. As already stated, the reed switch 15 is turned on when the amount of remaining toner is small. If the switch 15 is on, step 3 follows, whereas if the switch 15 is off, the sequence proceeds to step 4 to change a toner empty flag F to "0" and then returns. The toner empty flag F indicates the state of the reed switch 15 in the preceding routine. The flag F, if "1", shows that the switch 15 was on in the preceding routine. If the flag is "0", this indicates that the switch was off.

When the flag F is found to be "0" in step 3, indicating that the reed switch 15 has changed from off state to on state, the sequence proceeds to step 5, whereas if the flag F is "1", the sequence returns immediately. In step 5, the flag F is set to "1", indicating that the reed switch 15 is on, followed by step 6.

Step 6 checks whether the count on a counter C is "2". The counter C counts how many times the reed switch 15 has changed from off state to on state, so as to preclude the detection error that the reed switch 15 is turned on despite the presence of a sufficient amount of toner, for example, when a supply of toner is fed out. More specifically, even if no toner is present under the empty detector plate 13 as when the toner has been supplied, the detector plate 13 checks the toner three times by its pivotal movement, and the judgment of toner empty is made only when the reed switch 15 is actuated every time, i.e. three times. Upon supply of the toner, another portion of toner is promptly brought to the position under the detector plate 13, so that the decision of toner empty will not be made usually in such an event. When the tank 1 is actually emptied of the toner, the counter C advances to "2" in step 6, that is, the reed switch 15 changes from off state to on state three times, whereupon the sequence proceeds to step 7 to turn on the display 17 for the indication of toner empty. If the count on the counter C is not "2", step 6 is followed by step 8, in which the counter C is incremented.

Although not shown in the flow chart, the detection system is initialized to reset the counter C to "0" when the power supply for the main apparatus is turned on.

Thus with the present embodiment, the absence of toner is reliably detected by a simple arrangement including the toner empty detector plate 13 which is pivotally movable with the rotation of the second screw roller 3. Further because the detection of toner empty by the detector plate 13 is effected at the lower portion of the inclined bottom of the storage tank 1, the absence of toner can be detected with improved reliability even. after the quantity of toner has decreased.

Although the bottom of the toner storage tank is given a predetermined inclination with respect to a horizontal plane according to the present invention, the bottom need not always be so inclined. With the device of the invention, the toner is transported by the second transport member in a direction opposite to the direction of transport by the first transport member and is consequently circulated through the bottom of the storage tank without the likelihood of displacement toward one direction. Nevertheless, the bottom of the storage tank, when inclined as in the present embodiment, precludes the possible displacement of toner more effectively.

Further although the cover provided over the first toner transport member and the toner supply opening is so shaped as to form a tunnel, the cover need not always be so shaped.

While the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A toner supplying device for supplying toner to an electrostatic latent image developing unit, said toner supplying device comprising:

a storage tank for accommodating a toner therein;

a first transport member disposed within said storage tank for transporting the toner;

a second transport member disposed within said storage tank for transporting the toner in a direction opposite to the direction of transporting by said first transport member;

a supply opening in the bottom of said storage tank below said first transport member for passing said toner therethrough; and a cover covering said supply opening and defining a tunnel in which said first transport member is at least partially disposed for partially restricting the flow of toner through said supply opening.

2. The toner supplying device as claimed in claim 1, wherein toner transport paths defined by said first and second transport members are inclined with respect to a horizontal plane.

3. A toner supplying device as claimed in claim 1 wherein the bottom of said toner storage tank is given a predetermined inclination with respect to a horizontal plane.

4. A toner supplying device as claimed in claim 2 wherein said first transport member transports the toner from a lower portion of the inclined bottom surface toward an upper portion thereof.

5. A toner supplying device as claimed in claim 1 wherein said cover is provided with a vibration plate on its top for preventing toner from accumulating thereon.

6. A toner supplying device for supplying toner to an electrostatic latent image developing unit, said toner supplying device comprising:

a storage tank for accommodating a toner therein;

a first transport member disposed within said storage tank and at the lower portion of said tank and drivingly rotatable for transporting the toner in the longitudinal direction of said tank;

a second transport member disposed within said storage tank and at the lower portion of said tank in parallel with said first transport member and drivingly rotatable for transporting the toner in a direction opposite to the direction of transporting by said first transport member;

a supply opening in the bottom of said storage tank and located in the first toner path defined by said first transport member; and a cover covering said supply opening and defining a tunnel through which said first transport member is disposed for partially restricting the flow of toner to said first transport member and through said supply opening.

7. A toner supplying device as claimed in claim 6 wherein said cover is provided with a vibration plate on its top for preventing toner from accumulating thereon.

* * * * *